US007083686B2

(12) United States Patent
Itou

(10) Patent No.: US 7,083,686 B2
(45) Date of Patent: Aug. 1, 2006

(54) STEEL PRODUCT FOR OIL COUNTRY TUBULAR GOOD

(75) Inventor: Takahito Itou, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/186,956

(22) Filed: Jul. 22, 2005

(65) Prior Publication Data

US 2006/0018783 A1 Jan. 26, 2006

(30) Foreign Application Priority Data

Jul. 26, 2004 (JP) ..... 2004-216694

(51) Int. Cl.
*C21D 11/00* (2006.01)
*C22C 38/22* (2006.01)

(52) U.S. Cl. ..... 148/506; 148/334; 148/505; 420/105; 420/107; 420/110; 420/111

(58) Field of Classification Search ..... 148/334, 148/505, 506; 420/105, 107, 110, 111
See application file for complete search history.

(56) References Cited

U.S. PATENT DOCUMENTS

2004/0149359 A1* 8/2004 Michaud et al. ..... 148/546

FOREIGN PATENT DOCUMENTS

| | | | |
|---|---|---|---|
| FR | 2847910 | * | 6/2004 |
| JP | 61-223166 | | 10/1986 |
| JP | 03-020443 | | 1/1991 |
| JP | 04-021718 | | 1/1992 |
| JP | 06-116635 | * | 4/1994 |

* cited by examiner

*Primary Examiner*—Sikyin Ip
(74) *Attorney, Agent, or Firm*—Clark & Brody

(57) ABSTRACT

A steel product for oil country tubular good according to the invention comprises, in mass %, 0.10% to 0.35% C, 0.10% to 0.50% Si, 0.10% to 0.80% Mn, up to 0.030% P, up to 0.010% S, 0.30% to 1.20% Cr, 0.20% to 1.00% Mo, 0.005% to 0.40% V, 0.005% to 0. 100% Al, up to 0.0100% N, up to 0.0010% H, 0 to 0.01% Ca, 0 to 0.050% Ti, 0 to 0.050% Nb, and 0 to 0.0050% B, and the balance of Fe and impurities. The Cr, Mo, and V contents and the grain size GS satisfy expression (1):

$$0.7 \leqq (1.5\times Cr+2.5\times Mo+V)-GS/10 \leqq 2.6 \quad (1)$$

4 Claims, 1 Drawing Sheet

STEEL PRODUCT FOR OIL COUNTRY TUBULAR GOOD

This application claims priority under U.S.C. 35 119 of Japanese Patent Application No. 2004-216694 filed Jul. 26, 2004.

BACKGROUND OF THE INVENTION

1. Field of the Invention

The present invention relates to a steel product for oil country tubular good, and more specifically, to a steel product for oil country tubular good having high SSC (sulfide stress corrosion cracking) resistance.

2. Description of the Related Art

Oil country tubular goods are used for collecting and producing crude oil or natural gas. The oil country tubular good has its both ends threaded, and as the drilling proceeds to deeper levels in an oil or gas well, a plurality of such goods are successively connected. At the time, the goods are subjected to stress by their own weights. Therefore, the oil country tubular good must have high strength.

The oil country tubular good must have SSC resistance, because it is used in a moist (sour) environment containing hydrogen sulfide. Sulfide stress corrosion cracking is caused when stress acts upon the steel product in the sour environment, and the higher the strength of the steel product is, the lower the SSC resistance becomes. In an oil country tubular good with high strength in particular, cracking can easily be propagated. Therefore, in order to improve the SSC resistance of an oil country tubular good with high strength, the crack arrest toughness of the SSC must be improved.

The following measures for improving the SSC resistance of an oil country tubular good with high strength have been reported.

(1) To temper steel at high temperature after quenching the steel. To add Cr, Mo, V, and the like to the steel in order to improve the hardenability and the resistance to temper softening.

(2) To refine the grain size of the steel (see Japanese Patent Laid-Open Nos. S61-223166 and H03-20443).

(3) To prevent prior austenite grain boundary cracking (see Japanese Patent Laid-Open No. H04-21718).

However, steel products subjected to these measures (1) to (3) were evaluated for their SSC resistance based on a tensile test or a bending test such as Method A test or Method B test defined by NACE TM0177. A smooth specimen is used for these tests, and therefore the tests do not evaluate the crack arrest toughness of the SSC. Therefore, a steel product evaluated to have high SSC resistance may suffer from SSC when potential cracking in the steel propagates.

In recent years, as wells have come to be drilled deeper, even higher SSC resistance is requested for oil country tubular goods. Therefore, in order to further improve the SSC resistance, it is preferable to prevent not only SSC initiation but also SSC propagation.

According to the disclosure of Japanese Patent Laid-Open No. H06-116635, the steel having a high Ni content can reduce SSC caused by propagation of potential cracking. However, Ni is expensive and the use of Ni increases the manufacturing cost of the steel product.

SUMMARY OF THE INVENTION

It is an object of the invention to provide a steel product for oil country tubular good having high SSC resistance by reducing cracking propagation.

In order to reduce SSC caused by cracking propagation in steel, the toughness of the steel must be improved. In order to effectively improve the toughness of the steel, the steel must be quenched and tempered, so that the steel has a structure of martensite. In order to increase the ratio of martensite in the steel, its hardenability must be improved. The hardenability can be improved in the following two ways.

(A) To increase the prior austenite grain size before quenching.

(B) To add Cr, Mo, and V.

If the grain size is increased according to (A), the hardenability improves but if the grain size is too large, the mechanical properties of the steel could be reduced.

If Cr, Mo, and V are added according to (B), the diffusion velocity of C in the steel is lowered, and the austenite structure can be prevented from being transformed into a pearlite structure. For the purpose, the quenched steel is made more easily transformable into a martensite structure. In short, these added elements improve the hardenability. However, excessive amounts of Cr, Mo, and V cause coarse carbide particles to be precipitated at grain boundaries during tempering. The coarse carbide particles precipitated at the grain boundaries are prone to act as the crack initiation site and facilitate the crack propagation. The coarse carbide particles increase the amount of absorbed hydrogen in the steel and reduce the SSC resistance. Therefore, excessive amounts of Cr, Mo, and V may improve the hardenability but could not prevent the crack initiation and the crack propagation.

From the above study results, the inventor has found that the hardenability of steel can be improved and the precipitation of the coarse carbide particles that cause cracks to initiate and propagate can be prevented by appropriately combining the measures (A) and (B).

The inventor examined about the relation between the Cr, Mo, and V contents in steel and the grain size and the SSC resistance. More specifically, using steel products for oil country tubular good containing, in percentage by mass, 0.10% to 0.35% C, 0.10% to 0.50% Si, 0.10% to 0.80% Mn, up to 0.030% P, up to 0.010% S, 0.30% to 1.20% Cr, 0.20% to 1.00% Mo, 0.005% to 0.40% V, 0.005% to 0.100% Al, up to 0.0100% N, up to 0.0010% H, 0 to 0.01% Ca, 0 to 0.050% Ti, 0 to 0.050% Nb, and 0 to 0.0050% B, and the balance of Fe and impurities, sulfide stress corrosion cracking tests were carried out according to NACE TM 0177 Method D, and the fracture toughness values $K_{ISSC}$ were obtained in a corrosive environment. At the time, the steel is thermally treated so that the yield stresses of the steel products for oil country tubular good were not less than 655 MPa.

FIG. 1 shows the test results. In FIG. 1, "O" represents the results according to which the fracture toughness values Kissc were larger than 25 ksi$\sqrt{}$inch, "X" represents the results according to which the fracture toughness values $K_{ISSC}$ were less than 25 ksi$\sqrt{}$inch.

The inventor has found that if the Cr, Mo, and V contents and the grain size satisfy the relation represented by expression (1), the fracture toughness value $K_{ISSC}$ in a corrosive environment is greater than 25 ksi$\sqrt{}$inch, and that the crack arrest toughness of the steel product for oil country tubular good can be improved. Stated differently, if expression (1) is satisfied, the SSC resistance of the steel product for oil country tubular good can be improved.

$$0.7 \leqq (1.5\times Cr+2.5\times Mo+V)-GS/10 \leqq 2.6 \quad (1)$$

where Cr, Mo, and V represent the Cr, Mo, and V contents in the steel (in mass %) and GS represents the grain size defined according to ASTM E112, in other words, the particle size.

The inventor has made the following invention based on the above-described findings.

A steel product for oil country tubular good according to the invention contains, in mass %, 0.10% to 0.35% C, 0.10% to 0.50% Si, 0.10% to 0.80% Mn, up to 0.030% P, up to 0.010% S, 0.30% to 1.20% Cr, 0.20% to 1.00% Mo, 0.005% to 0.40% V, 0.005% to 0.100% Al, up to 0.0100% N, up to 0.0010% H, 0 to 0.01% Ca, 0 to 0.050% Ti, 0 to 0.050% Nb, and 0 to 0.0050% B, and the balance of Fe and impurities. The Cr, Mo, and V contents and the grain size GS satisfy the following expression (1):

$$0.7 \leqq (1.5\times Cr+2.5\times Mo+V)-GS/10 \leqq 2.6 \quad (1)$$

where the grain size GS is defined according to ASTM E112.

The steel product preferably further contains 0.001% to 0.01% Ca.

The steel product further preferably contains at least one of 0.005% to 0.050% Ti, 0.005% to 0.050% Nb, and 0.0005% to 0.0050% B.

The steel product preferably has a yield stress of at least 758 MPa.

The foregoing and other objects, features, aspects, and advantages of the present invention will become more apparent from the following detailed description of the present invention when taken in conjunction with the accompanying drawings.

DETAILED DESCRIPTION OF THE PREFERRED EMBODIMENTS

Figure 1:
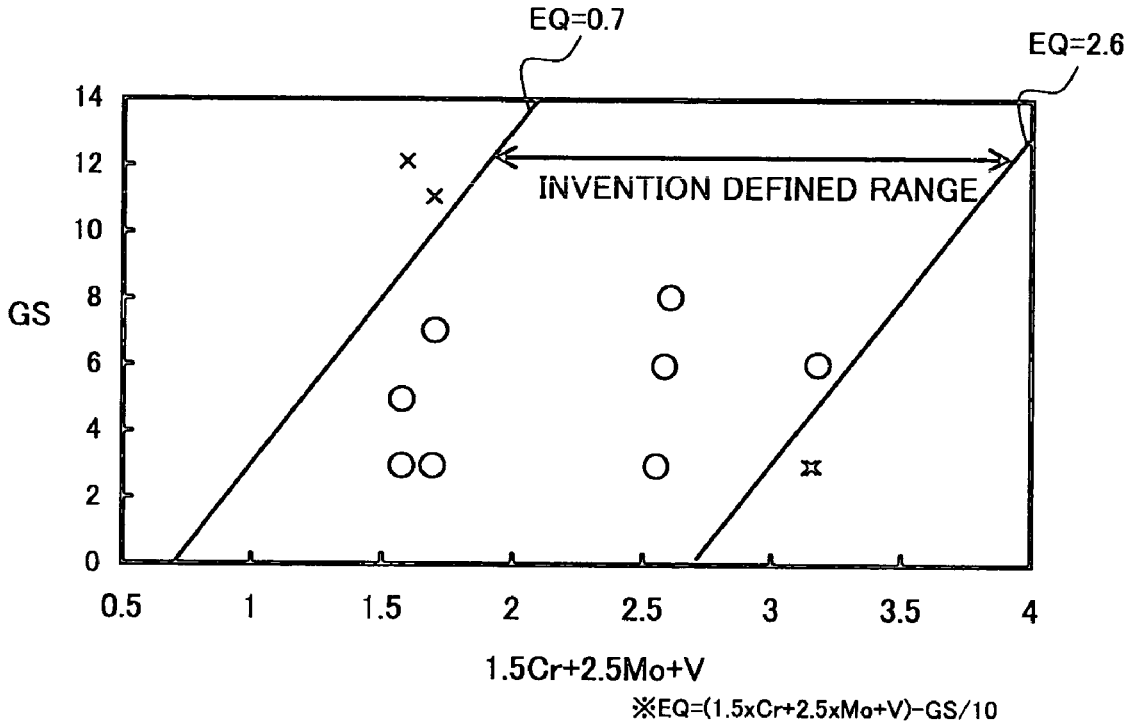
FIG. 1 is a table having yield toughness values $K_{ISSC}$ relative to the Cr, Mo, and V contents in steel and the grain size under corrosive stress.

Now, an embodiment of the invention will be described in detail in conjunction with the accompanying drawing. In the description, the same or corresponding portions are represented by the same reference characters and their description will not be repeated.

1. Chemical Composition

A steel product for oil country tubular good according to the embodiment has the following composition. Hereinafter, "%" for alloying elements stands for percentage by mass.

C: 0.10% to 0.35%

Carbon is an element that effectively increases the strength of the steel. The lower limit for the C content is 0.10% in order to keep strength necessary for an oil country tubular good. Meanwhile, excessive C addition causes quenching cracks, and therefore the upper limit for the C content is 0.35%. The C content is preferably in the range from 0.20% to 0.30%.

Si: 0.10% to 0.50%

Silicon is an element that effectively deoxidizes and increases the strength of the steel. In order to obtain this effect, the lower limit for the Si content is 0.10%. Meanwhile, excessive Si added to steel reduces the toughness of the steel. Therefore, the upper limit for the Si content is 0.50%. The Si content is preferably from 0.10% to 0.30%.

Mn: 0.10% to 0.80%

Manganese is an element that effectively desulfurizes steel. Manganese also increases the strength and toughness of steel. In order to obtain this effect, the lower limit for the Mn content is 0.10%. Meanwhile, excessive Mn added to steel causes P and S in the steel to be segregated and reduces the toughness of the steel. Therefore, the upper limit for the Mn content is 0.80% and the Mn content is preferably in the range from 0.30% to 0.70%.

P: up to 0.030%

Phosphorus is an impurity that reduces the toughness of steel. Therefore, the P content is preferably as small as possible. The P content is therefore not more than 0.030%. The P content is preferably not more than 0.015%.

S: up to 0.010%

Sulfur is an impurity that reduces the toughness of steel. Therefore, the S content is preferably as small as possible. The S content is therefore not more than 0.010%. The S content is preferably not more than 0.005%.

Cr: 0.30% to 1.20%

Chromium improves the hardenability and the resistance to temper softening. Therefore, the element improves the strength and SSC resistance. In order to obtain this effect, the lower limit for the Cr content is 0.30%. Meanwhile, excessive Cr added to steel causes coarse carbide particles to be precipitated in the steel. If the coarse carbide particles increase, the SSC resistance is lowered. Therefore, the upper limit for the Cr content is 1.20%.

Mo: 0.20% to 1.00%

Molybdenum improves the hardenability and the resistance to temper softening similarly to Cr. In order to obtain this effect, the lower limit for the Mo content is 0.20%. Meanwhile, excessive Mo added to steel causes coarse carbide particles to be increased in the steel. The upper limit for the Mo content is therefore 1.00%.

V: 0.005% to 0.40%

Vanadium improves the hardenability and the resistance to temper softening similarly to Cr and Mo. In order to obtain this effect, the lower limit for the V content is 0.005%. Meanwhile, excessive V added to steel causes coarse carbide particles to be increased in the steel. The upper limit for the V content is therefore 0.40%.

Al: 0.005% to 0.100%

Aluminum is an element necessary for deoxidizing steel. In order to obtain this effect, the lower limit for the Al content is 0.005%. Meanwhile, excessive Al added to steel increases inclusions in the steel, which reduces the toughness of the steel. The upper limit for the Al content is therefore 0.100%. The Al content is preferably in the range from 0.005% to 0.050%.

N: up to 0.0100%

Nitrogen is an impurity that reduces the toughness of steel. The N content is preferably as low as possible. Therefore, the N content is not more than 0.0100%.

H: 0.0010% or less

Hydrogen is an impurity and sometimes increases the sensitivity of SSC. Therefore, the H content is preferably as small as possible. The H content is therefore not more than 0.0010%.

Note that the balance is of Fe, but impurities may be included for various reasons during manufacturing.

In the above-described chemical composition, the contents of Cr, Mo, and V, and the grain size satisfy the following expression (1):

$$0.7 \leqq (1.5\times Cr+2.5\times Mo+V)-GS/10 \leqq 2.6 \quad (1)$$

where Cr, Mo, and V represent the contents of Cr, Mo, and V in mass %, and GS represents the grain size. The grain size is measured by grain size tests according to ASTM E112. Note that the grain size is measured after the process of quenching carried out before the final tempering in the process of manufacturing a steel product for oil country tubular good. Note however that the size may be measured after the final tempering process.

The steel product for oil country tubular good according to the embodiment further includes Ca if necessary.

Ca: 0 to 0.0100%

Calcium makes the shape of MnS inclusions, potential initiation sites of SSC, more globular and prevents SSC initiation. In order to obtain this effect, the lower limit for the Ca content is 0.001%. Meanwhile, excessive Ca added to steel reduces the SSC resistance rather than improving it and reduces the toughness. Therefore, the upper limit for the Ca content is 0.0100%. The Ca content is preferably in the range from 0.001% to 0.0050%. Note that the addition of Ca within this range does not reduce the characteristic of the crack arrest toughness in the steel product.

The steel product for oil country tubular good according to the embodiment further includes at least one of Ti, Nb, and B if necessary. Titanium, Nb, and B are elements that effectively increase the toughness and strength. Now, these elements will specifically be described.

Ti: 0 to 0.050%

Titanium fixes N and increases a solid solution of B, which improves the hardenability of steel. More specifically, Ti does not allow N to be formed into a solid solution independently, but allows N to be precipitated as TiN in order to improve the toughness and strength. In order to obtain this effect, the lower limit for the Ti content is 0.005%. Meanwhile, excessive Ti added to steel reduces the toughness of the steel rather than improving it. Therefore, the upper limit for the Ti content is 0.050%.

Nb: 0 to 0.050%

Niobium refines the grain size and improves the toughness and strength. In order to obtain this effect, the lower limit for the Nb content is 0.005%. Meanwhile, excessive Nb added to steel reduces the toughness of steel rather than improving it, and therefore the upper limit for the Nb content is 0.050%.

B: 0 to 0.0050%

Boron improves the hardenability of steel. In order to obtain this effect, the lower limit for the B content is 0.0005%. Meanwhile, excessive B added to steel causes this effect to be saturated, and therefore the upper limit for the B content is 0.0050%.

Note that when expression (1) is satisfied, the characteristic of the crack arrest toughness in the steel product is not reduced with the addition of Ti, Nb, and B within the ranges described above.

2. Manufacturing Method

A method of manufacturing the steel product for oil country tubular good according to the embodiment will be described. According to the invention, the grain size of the steel product is estimated before the manufacture, and the amounts of Cr, Mo, and V to be added can be determined based on the estimated grain size and expression (1). Therefore, the initiation and propagation of SSC because of carbide produced by addition of excessive Cr, Mo, V can be prevented.

The grain size can be estimated based on heat treatment for the steel product. More specifically, the size can be estimated based on the temperature for quenching, rate of heating, and holding time after a seamless steel pipe is produced by hot-working slabs or billets, and the rate of cooling during quenching.

Note that as the number of times quenching is carried out increases, the grain size becomes smaller. The grain size after quenching is substantially equal to the grain size after tempering after quenching.

After the grain size is estimated based on the heat treatment process, the Cr, Mo, and V contents are determined based on the estimated grain size and expression (1). Then, Cr, Mo, and V are added based on the determined contents. The molten steel is cast into billets by continuous casting. The steel may be cast into slabs and rolled into billets.

The billets are used to manufacture steel products for oil country tubular good. More specifically, the billets are heated in a heating furnace, and the billets extracted from the heating furnace are pierced in the axial direction using a piercer. The resultant pieces are produced into seamless steel pipes having a prescribed size using a mandrel mill, a reducer, or the like. After the working, the pipes are heat treated (quenching and tempering) in the heat treatment condition used for estimating the grain size. At the time, the tempering condition is adjusted so that the yield stress of each steel product for oil country tubular good is at least 655 MPa. The yield stress is preferably at least 758 MPa. In this way, the steel product for oil country tubular good is manufactured.

EXAMPLE 1

Using test products (inventive and comparative steel) having compositions and grain sizes as given in Table 1, steel products for oil country tubular goods were produced and examined for the fracture toughness $K_{ISSC}$ in a corrosive environment.

TABLE 1

| | | composition (with balance of Fe and impurities, in mass %) | | | | | | | | | | |
|---|---|---|---|---|---|---|---|---|---|---|---|---|
| | NO | C | Si | Mn | P | S | Cr | Mo | Ti | V | Nb | Al |
| invented steel | 1 | 0.28 | 0.24 | 0.42 | 0.009 | 0.001 | 0.46 | 0.27 | 0.017 | 0.19 | 0.008 | 0.033 |
| | 2 | 0.28 | 0.24 | 0.42 | 0.009 | 0.001 | 0.46 | 0.27 | 0.017 | 0.19 | 0.008 | 0.033 |
| | 3 | 0.27 | 0.29 | 0.42 | 0.007 | 0.001 | 0.49 | 0.68 | 0.019 | 0.09 | 0.026 | 0.042 |
| | 4 | 0.28 | 0.26 | 0.40 | 0.005 | 0.001 | 0.50 | 0.69 | — | 0.08 | — | 0.040 |
| | 5 | 0.27 | 0.29 | 0.42 | 0.009 | 0.001 | 0.51 | 0.69 | 0.018 | 0.09 | 0.023 | 0.035 |
| | 6 | 0.27 | 0.22 | 0.63 | 0.012 | 0.002 | 0.57 | 0.31 | 0.015 | 0.04 | 0.002 | 0.035 |
| | 7 | 0.27 | 0.23 | 0.64 | 0.010 | 0.002 | 0.59 | 0.30 | — | 0.05 | — | 0.034 |
| | 8 | 0.28 | 0.28 | 0.44 | 0.006 | 0.001 | 0.90 | 0.71 | 0.012 | 0.02 | 0.027 | 0.044 |

TABLE 1-continued

| | | | | | | | | | | | | |
|---|---|---|---|---|---|---|---|---|---|---|---|---|
| | 9 | 0.28 | 0.26 | 0.42 | 0.008 | 0.002 | 1.01 | 0.72 | 0.014 | 0.01 | 0.021 | 0.032 |
| comparative steel | 10 | 0.27 | 0.24 | 0.42 | 0.009 | 0.001 | 0.47 | 0.27 | 0.019 | 0.20 | 0.008 | 0.033 |
| | 11 | 0.28 | 0.21 | 0.58 | 0.012 | 0.002 | 0.56 | 0.31 | 0.014 | 0.05 | 0.001 | 0.044 |
| | 12 | 0.28 | 0.29 | 0.43 | 0.006 | 0.001 | 0.88 | 0.71 | 0.011 | 0.01 | 0.028 | 0.044 |
| | 13 | 0.28 | 0.28 | 0.45 | 0.008 | 0.001 | 0.89 | 0.68 | 0.013 | 0.09 | 0.029 | 0.045 |

| | | composition (with balance of Fe and impurities, in mass %) | | | | | EQ | Yield Stress | $k_{ISSC}$ |
|---|---|---|---|---|---|---|---|---|---|
| | NO | B | Ca | N | H | GS | Value | (MPa) | (ksi$\sqrt{}$inch) |
| invented steel | 1 | 0.0012 | 0.0028 | 0.0043 | 0.0005 | 4.5 | 1.1 | 760 | 32 |
| | 2 | 0.0012 | 0.0028 | 0.0043 | 0.0003 | 5.0 | 1.1 | 765 | 33 |
| | 3 | 0.0012 | 0.0032 | 0.0047 | 0.0005 | 4.5 | 2.1 | 765 | 31 |
| | 4 | — | — | 0.0045 | 0.0004 | 6.0 | 2.0 | 769 | 30 |
| | 5 | 0.0016 | 0.0027 | 0.0038 | 0.0003 | 8.0 | 1.8 | 770 | 32 |
| | 6 | 0.0014 | 0.0020 | 0.0036 | 0.0004 | 4.5 | 1.2 | 768 | 31 |
| | 7 | 0.0014 | 0.0021 | 0.0036 | 0.0005 | 7.0 | 1.0 | 763 | 29 |
| | 8 | — | 0.0023 | 0.0038 | 0.0004 | 6.0 | 2.5 | 762 | 28 |
| | 9 | 0.0011 | — | 0.0042 | 0.0005 | 11.0 | 2.2 | 768 | 31 |
| comparative steel | 10 | 0.0011 | 0.0026 | 0.0037 | 0.0006 | 12.0 | 0.4 | 765 | 23 |
| | 11 | 0.0012 | 0.0034 | 0.0043 | 0.0005 | 11.0 | 0.6 | 768 | 22 |
| | 12 | 0.0013 | 0.0024 | 0.0038 | 0.0004 | 4.5 | 2.7 | 769 | 23 |
| | 13 | 0.0011 | 0.0002 | 0.0032 | 0.0003 | 4.5 | 2.7 | 770 | 24 |

Test products 1 to 13 were produced as follows. To begin with, molten steel was continuously cast into round billets. The round billets were heated at 1050° C. to 1200° C. in a heating furnace, and then the billets taken out from the furnace were pierced in the axial direction using a piercer and formed into hollow shells. The hollow shells were rolled using a mandrel mill and a reducer, and seamless steel pipes were produced.

The produced seamless steel pipes were quenched. For example, the seamless steel pipes of the test products 1, 3, 6, 12, and 13 at 900° C. to 1000° C. after the rolling were directly charged into a heat treatment furnace without being cooled. Then, the furnace temperature was held at 950° C. Then, the pipes were quenched at a cooling rate of at least 10° C./sec.

The seamless steel pipes of the other test products at 900° C. to 1000° C. after the rolling were cooled in the air, and charged into the heat treatment furnace. Then, the temperature of the furnace was held at 920° C. Then, the pipes were quenched at a cooling rate of at least 5° C./sec and less than 10° C./sec.

The quenched seamless steel pipes were tempered so that the yield stress of each of the test products was in the range from 759 MPa to 800 MPa. Specimens were taken from the test products after the tempering, and subjected to tensile tests according to ASTM A370. As a result, the test products each had a yield stress in the range from 760 MPa to 770 MPa as given in Table 1.

Grain Size Test

Samples taken from the test products were subjected to grain size tests according to ASTM E112. The samples were taken from the seamless steel pipes after quenching.

Based on the measured grain sizes and the Cr, Mo, and V contents, EQ values represented by expression (2) were calculated.

$$EQ=(1.5\times Cr+2.5\times Mo+V)-GS/10 \quad (2)$$

The Cr, Mo, and V contents given in Table 1 were substituted for Cr, Mo, and V, respectively in expression (2). The grain sizes measured by the grain size tests were substituted for GS in expression (2).

The obtained EQ values are shown in Table 1. The EQ values of the test products 1 to 9 satisfied expression (1) defined by the invention. More specifically, the EQ values of the test products 1 to 9 were in the range from 0.7 to 2.6. Meanwhile, the EQ values of the test products 10 and 11 were below the lower limit by expression (1) defined by the invention. The EQ values of the test products 12 and 13 were beyond the upper limit by expression (1) defined by the invention.

Sulfide Stress Corrosion Cracking Test

Specimens were taken from the produced test products and examined for the fracture toughness $K_{ISSC}$ in a corrosive environment. The test products were subjected to sulfide stress corrosion cracking tests according to NACE TM-0177 Method D.

The test result is given in Table 1. The $K_{ISSC}$ values of the test products 1 to 9 were about 30% higher than those of the test products 10 to 13. More specifically, the $K_{ISSC}$ values of the test products 10 to 13 were 22 to 24 ksi$\sqrt{}$inch, while the $K_{ISSC}$ values of the test products 1 to 9 were 28 to 33 ksi$\sqrt{}$inch.

According to the embodiment, the test products after quenching are subjected to the grain size tests, but they may be tested after tempering and still the same result is obtained. This is because the grain size after quenching is substantially the same as that after the tempering.

A steel product for oil country tubular good according to the invention is applicable to an oil country tubular good for use in a sour environment.

Although the embodiment of the present invention has been described, the same is by way of illustration and example only and is not to be taken by way of limitation. The invention may be embodied in various modified forms without departing from the spirit and scope of the invention.

What is claimed is:

1. A steel product for oil country tubular good, comprising, in mass %, 0.10% to 0.35% C, 0.10% to 0.50% Si, 0.10% to 0.80% Mn, up to 0.030% P, up to 0.010% S, 0.30% to 1.20% Cr, 0.20% to 1.00% Mo, 0.005% to 0.40% V, 0.005% to 0. 100% Al, up to 0.0100% N, up to 0.0010% H, 0 to 0.01% Ca, 0 to 0.050% Ti, 0 to 0.050% Nb, and 0 to 0.0050% B, and the balance of Fe and impurities, the contents of said Cr, Mo, and V and the grain size GS satisfying expression (1):

$$0.7 \leqq (1.5 \times Cr + 2.5 \times Mo + V) - GS/10 \leqq 2.6 \quad (1).$$

2. The steel product according to claim 1, further comprising 0.001 to 0.01% Ca.

3. The steel product according to claim 1, further comprising at least one of 0.005% to 0.050% Ti, 0.005% to 0.050% Nb, and 0.0005% to 0.0050% B.

4. The steel product according to claim 1 having a yield stress of at least 758 MPa.

* * * * *